US009856690B2

(12) United States Patent
Ball et al.

(10) Patent No.: US 9,856,690 B2
(45) Date of Patent: Jan. 2, 2018

(54) SHOWER THRESHOLD AND METHODS OF IMPLEMENTATION

(71) Applicant: Kohler Co., Kohler, WI (US)

(72) Inventors: Matthew Joseph Ball, Sheboygan Falls, WI (US); Weerasak Taingtae, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/287,004

(22) Filed: Oct. 6, 2016

(65) Prior Publication Data

US 2017/0022748 A1 Jan. 26, 2017

Related U.S. Application Data

(62) Division of application No. 14/206,600, filed on Mar. 12, 2014, now Pat. No. 9,476,247.

(60) Provisional application No. 61/785,600, filed on Mar. 14, 2013.

(51) Int. Cl.

| | |
|---|---|
| ***E06B 1/70*** | (2006.01) |
| ***A47K 3/34*** | (2006.01) |
| ***A47K 3/40*** | (2006.01) |

(52) U.S. Cl.

CPC ..... *E06B 1/70* (2013.01); *A47K 3/34* (2013.01); *A47K 3/40* (2013.01); *E06B 1/702* (2013.01); *E06B 2001/707* (2013.01); *Y10T 29/49826* (2015.01)

(58) Field of Classification Search

CPC .... A47K 3/40; A47K 3/34; E06B 1/70; E06B 1/702; E06B 1/705; E06B 2001/707

USPC ..... 49/467, 469, 476.1, 489.1

See application file for complete search history.

(56) References Cited

U.S. PATENT DOCUMENTS

| | | | |
|---|---|---|---|
| 2,089,380 | A | 8/1937 | Kammerer |
| 2,374,490 | A | 4/1945 | Lehman |
| 2,575,657 | A | 11/1951 | Curley |
| 2,818,614 | A | 1/1958 | Lapka, Jr. |
| 2,849,763 | A | 9/1958 | Leigh |
| 2,851,744 | A | 9/1958 | Oehmig |
| 3,148,419 | A | 9/1964 | Straus et al. |

(Continued)

FOREIGN PATENT DOCUMENTS

| | | |
|---|---|---|
| CN | 201162432 | 12/2008 |
| CN | 201614840 | 10/2010 |

(Continued)

OTHER PUBLICATIONS

European Search Report dated Jun. 26, 2014 for Application No. 14159670.0, 9 pages.

*Primary Examiner* — Erin Deery
(74) *Attorney, Agent, or Firm* — Foley & Lardner LLP

(57) ABSTRACT

A shower threshold and a method of implementing a shower threshold are disclosed. The shower threshold includes an elongated base component having one or more sidewalls extending from a base region of the elongated base component to an apex of the elongated base portion. The shower threshold also includes a flexible cap coupled to and extending from the elongated base component along the apex of the elongated base component. The flexible cap may be composed of a plurality of layers. The plurality of layers includes a core layer and a shell layer. The core layer is composed of a material that is softer than the shell layer.

17 Claims, 8 Drawing Sheets

(56) References Cited

U.S. PATENT DOCUMENTS

| | | | | |
|---|---|---|---|---|
| 3,305,973 | A | 2/1967 | Bohn | |
| 3,855,732 | A | 12/1974 | Sheaf | |
| D244,535 | S * | 5/1977 | Doan | D23/271 |
| 4,076,262 | A | 2/1978 | Deventer | |
| 4,258,443 | A * | 3/1981 | Baus | A47K 3/34 16/90 |
| 4,551,870 | A | 11/1985 | Presti, Jr. | |
| 4,656,785 | A | 4/1987 | Yackiw | |
| 4,860,495 | A | 8/1989 | Kessler | |
| 5,001,865 | A | 3/1991 | Procton | |
| 5,469,666 | A | 11/1995 | Lewis, Jr. | |
| 5,581,949 | A | 12/1996 | Wu | |
| 5,673,517 | A | 10/1997 | Stanclift | |
| 5,990,042 | A | 11/1999 | Mochizuki et al. | |
| 6,094,757 | A | 8/2000 | Torres | |
| 6,300,279 | B1 | 10/2001 | Macedo | |
| 6,662,385 | B1 | 12/2003 | Bayne | |
| 6,735,793 | B2 | 5/2004 | Peterson | |
| 7,033,973 | B2 | 4/2006 | Fenzi | |
| 8,490,332 | B2 | 7/2013 | Van Camp et al. | |
| 2011/0180294 | A1 | 7/2011 | Qin et al. | |

FOREIGN PATENT DOCUMENTS

| | | |
|---|---|---|
| EP | 0342702 A1 | 11/1989 |
| WO | WO2004035311 | 4/2004 |
| WO | WO 2009/107154 | 9/2009 |

* cited by examiner

SHOWER THRESHOLD AND METHODS OF IMPLEMENTATION

CROSS-REFERENCE TO RELATED PATENT APPLICATIONS

The present application is a Divisional of U.S. patent application Ser. No. 14/206,600 (now U.S. Pat. No. 9,476,247), filed Mar. 12, 2014, which claims the benefit of and priority to U.S. Provisional Patent Application No. 61/785,600, filed Mar. 14, 2013 and entitled "SHOWER THRESHOLD AND METHODS OF IMPLEMENTATION," the entire contents of the foregoing applications are hereby incorporated by reference.

TECHNICAL FIELD

The presently disclosed embodiments relate generally to thresholds, particularly those used for shower doors. More specifically, the presently disclosed embodiments relate to thresholds for sliding shower doors and methods of implementing the same.

BACKGROUND

Showers equipped with sliding shower doors may include a frame for the shower doors to slide within. The frame of the shower doors, which may extend along the top, sides, and bottom, generally includes a plurality of channels that the shower doors are configured to slide within formed by a plurality of thin walls of the shower frame. The frame may be composed of a rigid material such as a metal. The rigid material forming the frame wall at the base of the shower door may extend the entire length of the shower and in addition to providing guidance for the shower doors may act as a water barrier to prevent water from exiting the shower at or below the base of the shower door and shower opening, including when the shower doors are opened to allow a user egress and ingress from the shower.

The rigid material forming the frame providing guidance for the shower doors to slide over or against typically protrudes upward from the base of the shower opening. A user of the shower traverses the upwardly extending thin walls when entering or exiting the shower. Stepping on the upwardly extending thin wall when entering or exiting the shower may provide an unpleasant, painful, and/or unsafe experience for the user.

In the absence of opening and closing the shower doors, padded items may be placed in the frame over the channels formed by the upwardly extending thin walls of the frame. Such padding which may be in the form of a towel or cushion, while possibly providing a comfortable surface impedes the shower doors from sliding over or against the frame.

SUMMARY

An exemplary embodiment relates to a shower threshold. The shower threshold includes an elongated base component having one or more sidewalls extending from a base region of the elongated base component to an apex of the elongated base portion. The shower threshold also includes a flexible cap coupled to and extending from the elongated base component along the apex of the elongated base component. The flexible cap is composed of one or more layers and may include a plurality of layers. In embodiments including a plurality of layers, the plurality of layers includes a core layer and a shell layer. The core layer is composed of a material that is softer than the shell layer.

An exemplary embodiment relates to a method of implementing a shower threshold. The method includes coupling a flexible cap to an elongated base component and securing the threshold at a base of an opening in the shower. The elongated base component includes one or more sidewall extending from a base region of the elongated base component to an apex of the elongated base portion. The method includes coupling the flexible cap to the elongated base component such that the flexible cap extends from the elongated base component along the apex of the elongated base component. The flexible cap is composed of one or more layers and may include a plurality of layers. In embodiments including a plurality of layers, the plurality of layers includes a core layer and a shell layer. The core layer is composed of a material that is softer than the shell layer.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Following below are more detailed descriptions of various concepts related to, and embodiments of, inventive apparatuses and methods for a shower threshold. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Referring generally to the Figures, various embodiments of a shower threshold are shown.

Figure 1:
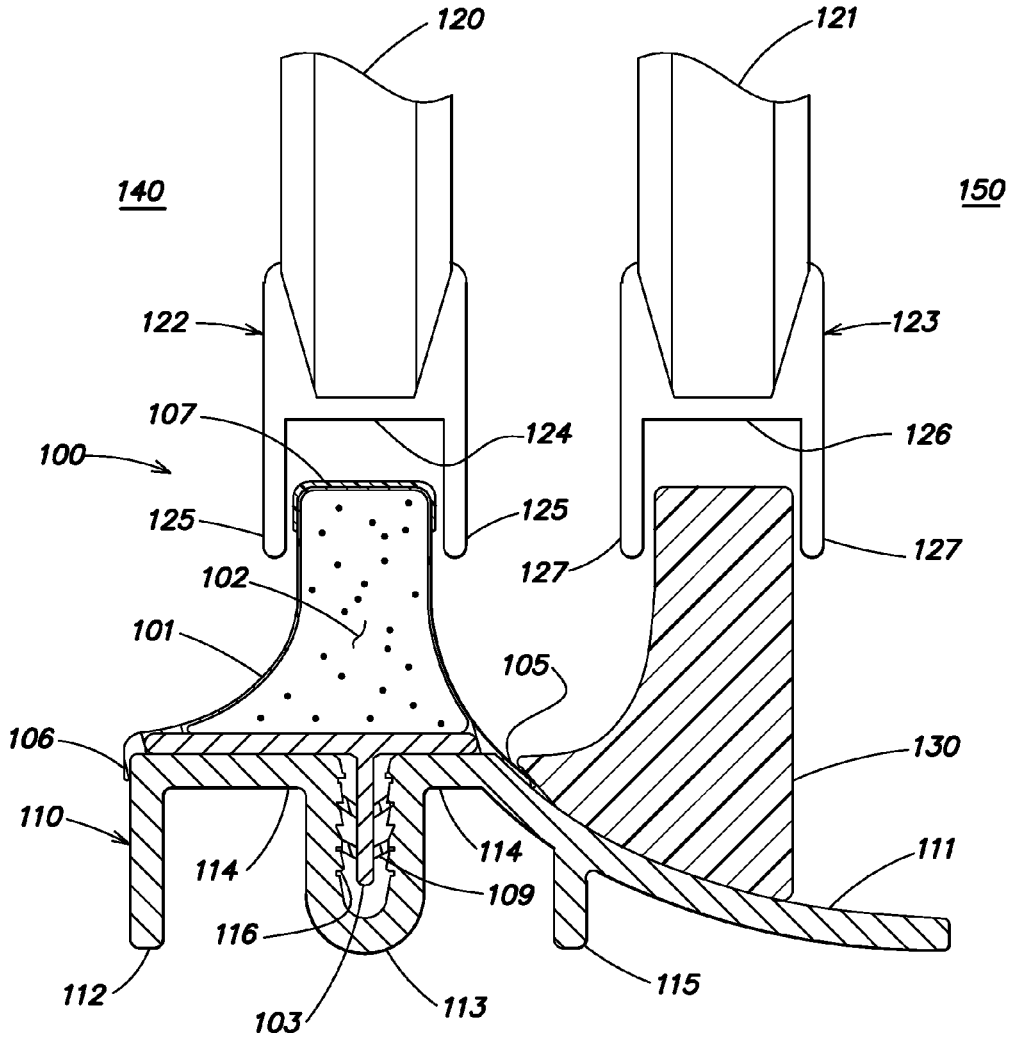
FIG. 1 is a side cross-sectional view of a shower threshold and sliding shower doors, in accordance with an exemplary inventive embodiment.

FIG. 1 is a side cross-sectional view of a shower threshold and sliding shower doors, in accordance with an exemplary inventive embodiment. Shower threshold 100 includes a flexible cap 101 coupled to an elongated base component 110. As discussed further herein, flexible cap 101 is configured to act as a guide for sliding shower doors and also provides a soft comfortable layer on threshold 100. Flexible cap 101 is coupled to an apex 114 of elongated base component 110, which apex in the illustrated embodiment is configured as a planar surface. In some embodiments, cap 101 may cover apex 114 in its entirety. Flexible cap 101 may include a plurality of layers, for example a foam core covered by a vinyl shell. Apex 114 may be configured in a curved or pointed surface, in accordance with various embodiments. Apex 114 includes a recess 113, in the illustrated embodiment, including a plurality of ridges 116 for engaging an engagement fin 109 of flexible cap 101. Flexible cap 101 provides threshold 100 with a soft flexible top surface, such that when shower doors 120 and 121 are moved to a position that allows a user to move from an area 140, outside of the shower, to an area 150, inside the shower, or vice versa, the user has a more comfortable surface for the feet of the user to rest on or traverse as he or she is entering or exiting the shower, in contrast to shower thresholds having a rigid surface particularly where the surface includes one or more thin walls extending upward from the threshold, which thin walls may form guiding features for the shower doors. As will be discussed further herein, flexible cap 101 may include a plurality of layers that permit the cap to provide a water resistive barrier while providing a soft yet resilient cap, which might be depressed or bent from a user stepping thereon and subsequently return to its erect position continuing to provide a barrier to prevent water from moving from region 150 inside the shower to region 140 outside of the shower. As demonstrated in FIG. 1, flexible cap 101 is also configured in the illustrated embodiment as a guide for outer shower door 120. Accordingly, shower door 120 may include a guide 122 having a recessed region 124 formed by side walls 125 of guide 122. Cap 101 may be shaped to fit within recessed region 124 and thereby provide a track for guide 122 of shower door 120. Flexible cap 101 may extend along the entire length of elongated base component 110, which may be shaped to fit along an entire base of an opening of a shower.

In accordance with various embodiments, elongated base component 110 may be formed out of a rigid material by an extrusion process. For example, elongated base component 110 may be formed from extruded aluminum, other metals, or other high rigidity and corrosion resistant materials. Elongated base component 110 may include one or more side walls 111 and 112 extending from a base or bottom region of the elongated base component (e.g. the region of component 110 configured for engagement with the base of an opening in a shower). As demonstrated in the illustrated embodiment, at least one of the walls may be shaped such that wall is sloped or inclined and gradually extends upward from the base of the elongated base component to apex surface 114. The angle of slope may range from nearly flat (a few degrees) to nearly perpendicular. The incline of wall 111, assists with returning water splashed therein, built up in/on the shower floor, or dripping from one of shower doors 120 and 121 back into the interior region 150 of the shower so that the water can be drained through a drain in the shower. In various embodiments, a center-guide 130 may be coupled to wall 111. Wall 111 may include one or more intermediate supporting walls 115 to reinforce wall 111 and prevent it from bending under loads from a user. In accordance with various embodiments, center-guide 130 may extend along only a portion of elongated base component 110 (in a direction of extension into the page in FIG. 1). In the illustrated embodiment provided by FIG. 1, center-guide 130, in a manner similar to cap 101, is configured as a rail for guide 123 of inner door 121. Center-guide 130 guides door 121 by as center-guide 130 is positioned in recess 126 formed by walls 127 of guide 123. Center-guide 130 may be composed of a rigid material, for example, the same material as elongated base component 110 or guide 130 may be composed of a distinct material in accordance with various embodiments.

Figure 6:
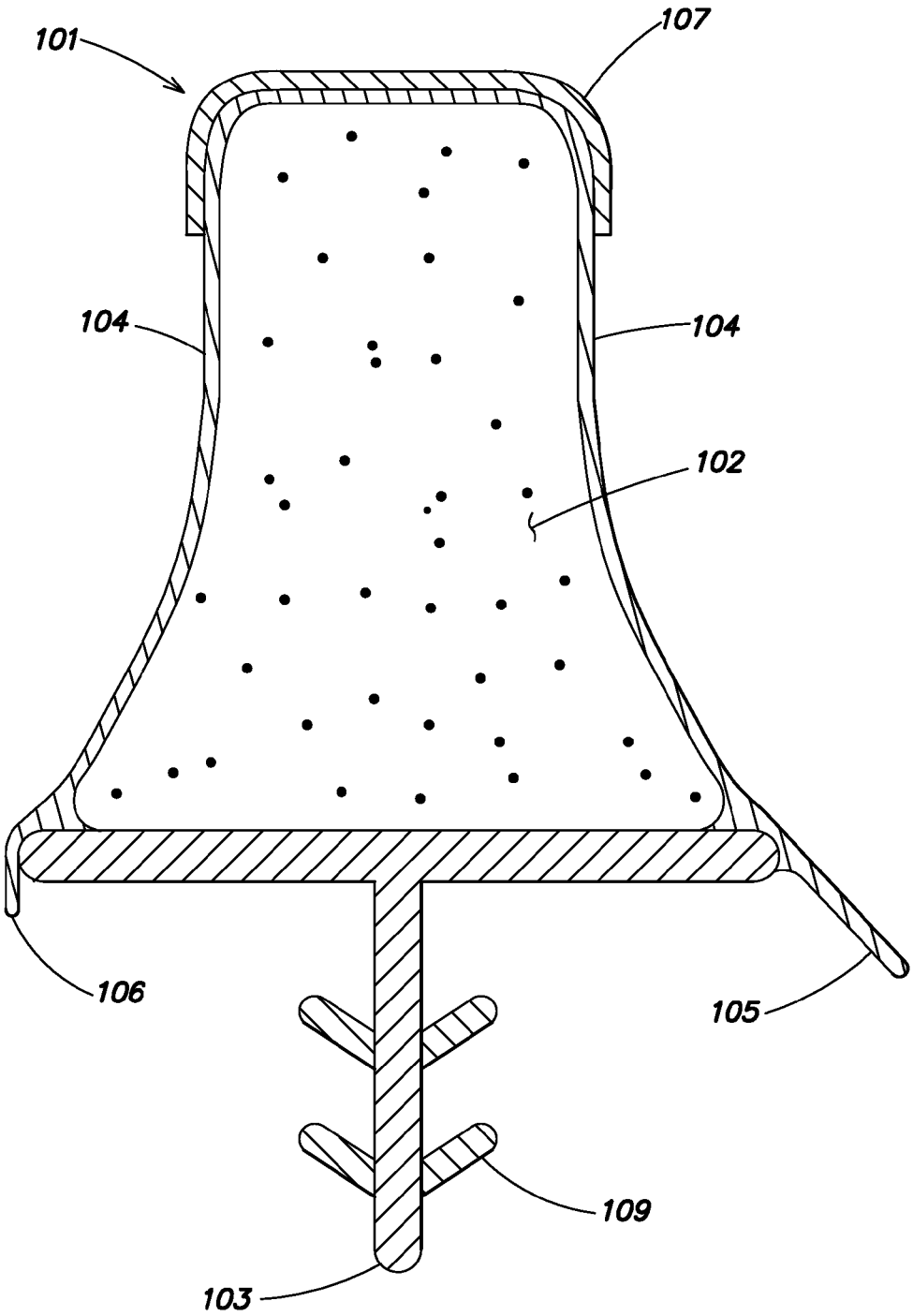
FIG. 6 illustrates a cross sectional view of a soft resilient cap portion of a shower threshold, in accordance with an exemplary inventive embodiment.

As further illustrated in FIGS. 1 and 6, flexible cap 101 may include one or more shrouds 105 and 106 that extend from apex 114 to one or more side walls 111 and 112 of elongated base component 110, thereby providing a smooth and shielded transition from apex 114 to wall 111. As will be discussed further herein, flexible cap 101 may include a contact layer 107. Contact layer 107 may be configured to interface with walls 125 of door 120 and may be composed of a material having abrasion resistive and low frictional properties, such as polyoxymethlene commonly referred to as Delrin, Celcon, and Hostaform. Exemplary configurations of multilayered flexible cap 101 are discussed further herein in connection with FIG. 6.

Figure 2:
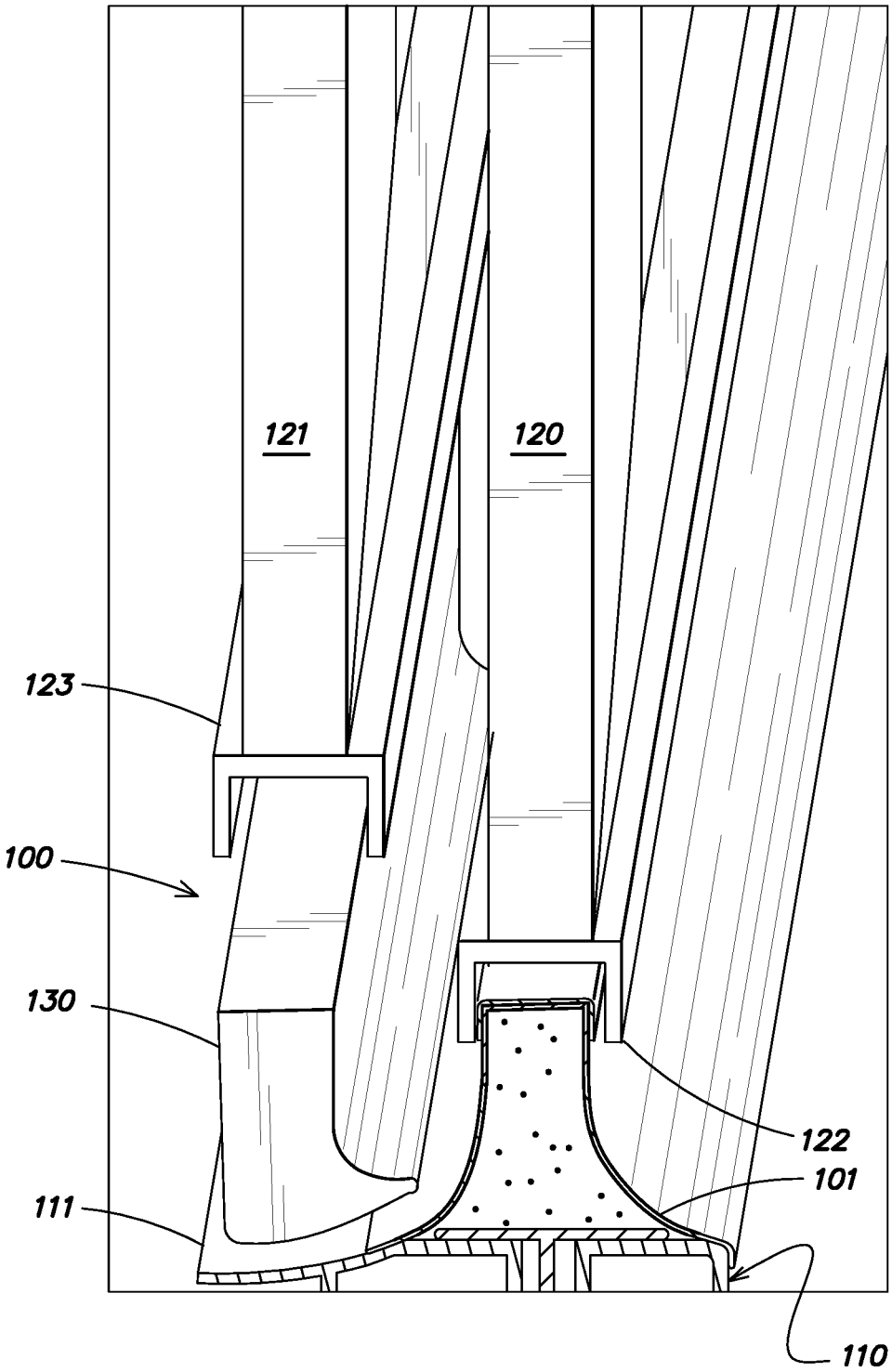
FIG. 2 is a perspective view of the shower threshold and sliding shower doors of FIG. 1.

FIG. 2 is a perspective view of the shower threshold and sliding shower doors of FIG. 1. As demonstrated by FIG. 2, shower threshold 100 provides a threshold assembly that is configured for use with the sliding doors, when the doors are in an opened or closed configuration. Shower threshold 100 provides a soft surface for a user to engage, while permitting and assisting with full continued sliding use of the shower doors, as threshold 100 does not impede doors 120 and 121 from sliding open or closed. As demonstrated in FIG. 2, center-guide 130 may be configured to extend along only a portion of elongated base component 110, in contrast to flexible cap 101 that may extend along half or more of the entire length of elongated base component 110.

Figure 3:
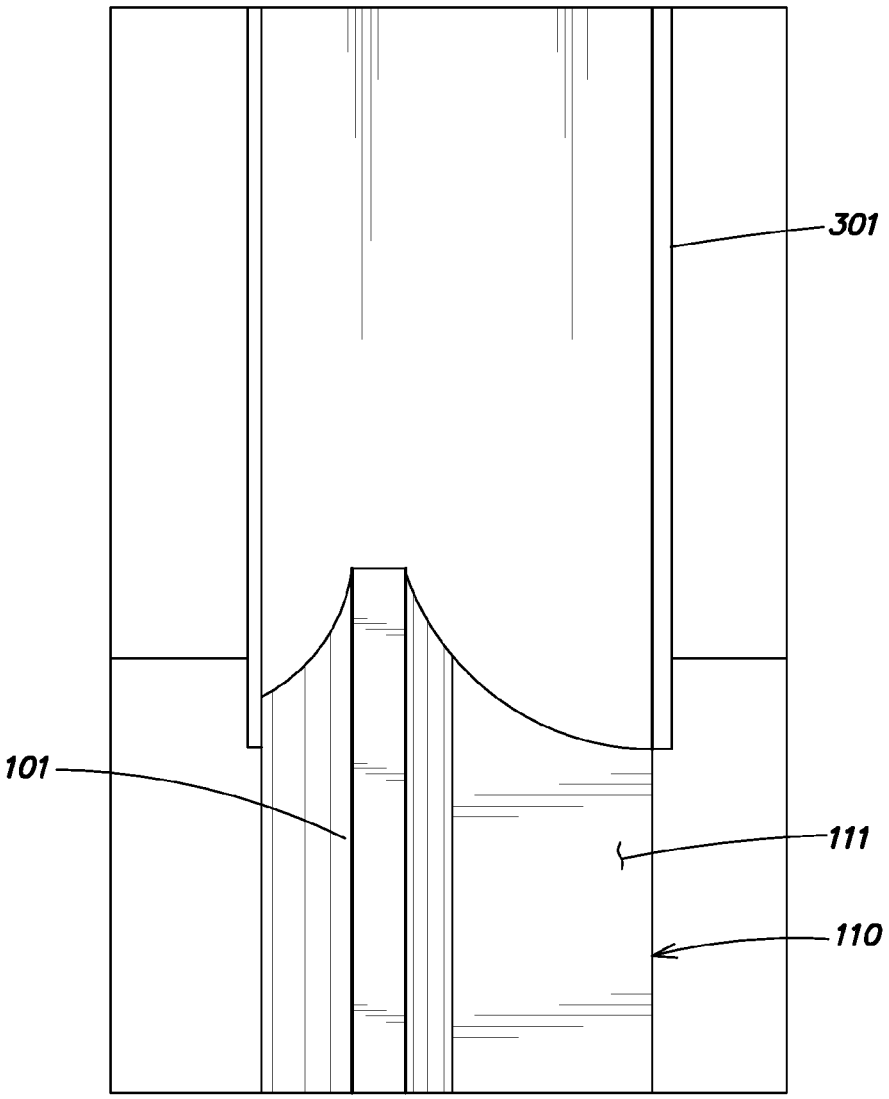
FIG. 3 is a perspective view of the shower threshold of FIG. 1 at a junction with a shower door frame.

FIG. 3 is a perspective view of the shower threshold of FIG. 1 at a junction with a shower door frame. The shower door frame 301 may extend around a peripheral portion of an opening in the shower. FIG. 3 illustrates shower threshold 100 at an extremity of the opening and demonstrates further the extension of flexible cap 101 and elongated base portion 101 to extremities of the shower opening. Center-guide 130 is not shown in FIG. 3, as center-guide 130 generally extends only along a portion of elongated base component 110 and not from one extremity of the shower opening to another. Center-guide 130 may be at the center of elongated base component 110 and may extend only a couple of inches in opposite directions from the center of elongated base component 110 along component 110.

Figure 4:
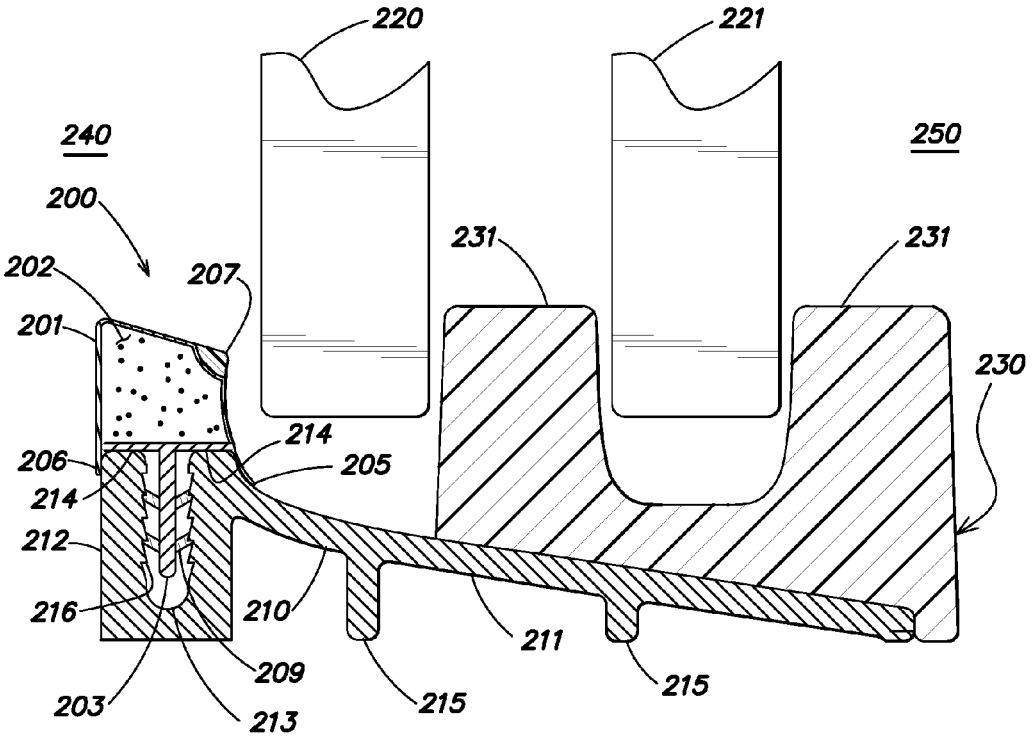
FIG. 4 is a side cross-sectional view of another shower threshold and sliding shower doors, in accordance with an exemplary inventive embodiment.

FIG. 4 is a side cross-sectional view of another shower threshold and sliding shower doors in accordance with an exemplary inventive embodiment. FIG. 4 provides a threshold 200 where components of the threshold form channels that inner shower door 220 and outer shower door 221 are positioned between. Threshold 200 includes a flexible cap 201 coupled to an elongated base component 210. Flexible cap 201 may assist in guiding shower door 221 when sliding from one position to another. Flexible cap 201 is coupled to an apex 214 of elongated base component 210. Apex surface 214 includes a recess 213 disposed therein. Apex 214 is positioned along a peripheral portion of elongated base portion 210. Recess 213 in the illustrated embodiment, includes a plurality of ridges 216 for engaging engagement fin 202 of flexible cap 201. Flexible cap 201, in a manner similar to cap 101, provides threshold 200 with a soft flexible top surface, such that when shower doors 220 and 221 are moved to a position that allows a user to move from an area 240, outside of the shower, to an area 250, inside the shower, the user has a more comfortable surface for their feet to rest on or traverse as he or she is entering or exiting the shower. Flexible cap 201 is configured such that shower doors 220 and 221, particularly the base of doors 220 and 221, will be positioned between cap 201 and the interior of shower (e.g. region 250). As will be discussed herein, flexible cap 201 which may be composed of a plurality of layers to provide a soft, yet water resistive barrier, may include at least one layer that is composed of a low friction and/or abrasion resistive material. The layer may also be relatively rigid with respect to one or more shell or core layers of flexible cap 201.

In accordance with various embodiments, elongated base component 210 may be formed out of a rigid material by an extrusion process. For example, elongated base component 210 may be formed from extruded aluminum. Elongated base component 210 may include one or more side walls 211 and 212 extending from a base or bottom region of the elongated base component (e.g. the region of component 210 configured for engagement with the base of an opening in a shower). As demonstrated in the illustrated embodiment, at least one of the walls may be shaped such that wall 211 is inclined and gradually extends upward from the base of the elongated base component to apex surface 214. By contrast, to wall 211, side wall 212 may be substantially vertical. The gradual incline of wall 211 assist with returning water splashed therein, built up on the shower floor, or dripping from one of shower doors 220 and 221 back into the interior region 250 of the shower so that the water can be drained through a drain in the shower. In various exemplary embodiments, wall 211 may extend to a height less than 2 inches over a distance of less than 4 inches. Wall 211 may be supported by one or more supporting walls 215.

In various embodiments, a center-guide 230 may be coupled to wall 211. As demonstrated in some embodiments, a center-guide may include a plurality of side-walls 231 forming a channel 232 for guiding and maintaining the alignment of one or more shower doors, such as door 221, which door(s) may also be separately guided by a track or wheel and track combination positioned at the top of the door at the interface of the door and a door frame positioned in an opening of a shower.

As further illustrated in FIG. 4, flexible cap 201 may include one or more shrouds 205 and 206 that extend from apex 214 to one or more side walls 211 and 212 of elongated base component 210, providing a smooth and shielded transition there between. As will be discussed further herein, flexible cap 201 may include a contact layer 207. Contact layer 207 may be configured to interface with the base of door 220 and may be composed of a material having abrasion resistive and low frictional properties, such as polyoxymethlene. Exemplary configurations of a multilayered flexible cap 201 are discussed further herein in connection with FIG. 7.

Figure 5:
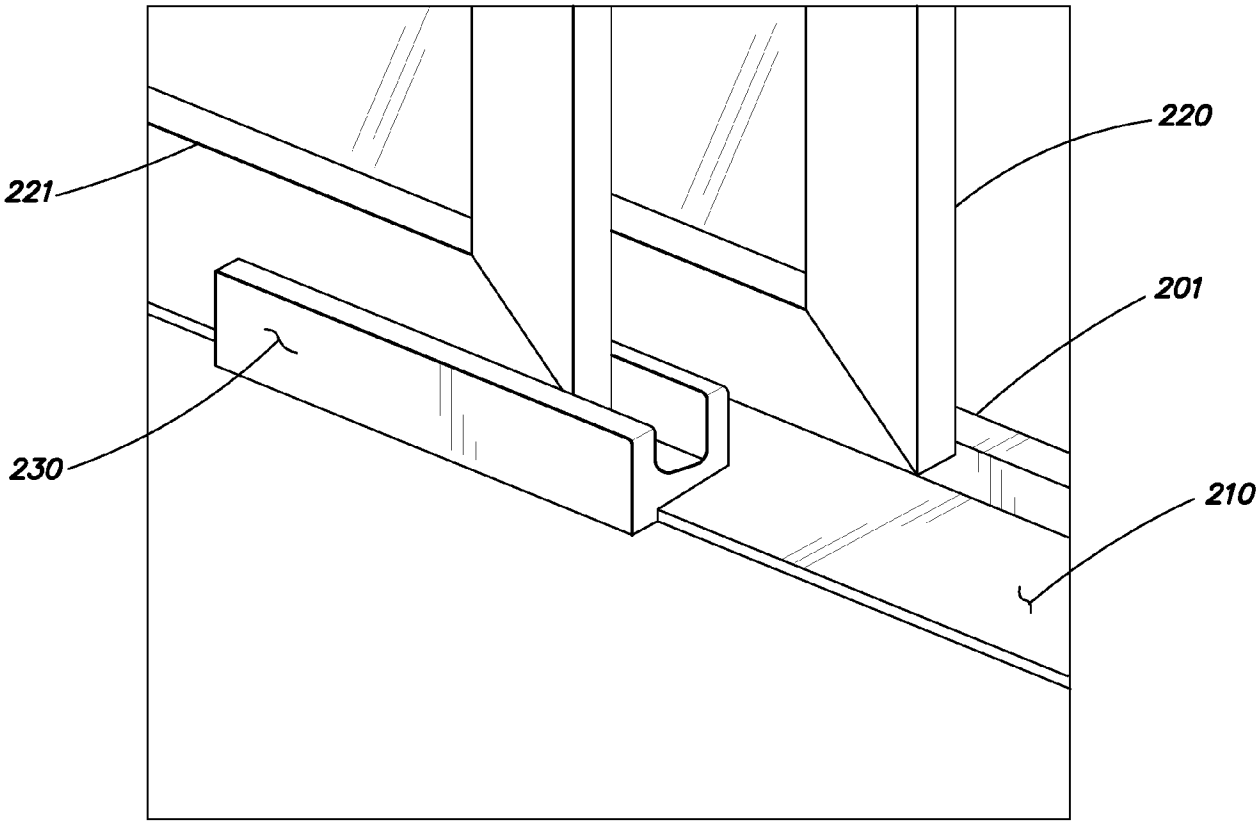
FIG. 5 provides is a perspective view of the shower threshold and sliding shower doors of FIG. 4.

FIG. 5 is a perspective view of the shower threshold and sliding shower doors of FIG. 4. In the illustrated embodiment of FIG. 4, inner door 221 is illustrated partially positioned in center-guide 230. Center-guide 230 generally extends only along a portion of the length of elongated base portion 210, while flexible cap 201 generally extends along half or more of the entire length of elongated base portion 210 providing a water barrier, guide, and a soft interface on the threshold when the doors are opened, closed, or disposed on either extremity of the shower opening.

FIG. 6 illustrates a cross sectional view of a soft resilient cap portion of a shower threshold, in accordance with an exemplary inventive embodiment. Flexible cap 101 may be composed of a plurality of layers in accordance with various embodiments. The plurality of layers assist with providing flexible cap 101 in a soft form for more comfortable interaction with the user, while still providing a resilient guide and water barrier. In accordance with various embodiments, cap 101 may include a core layer 102 composed of a resilient material, such as a foam, elastomers, or rubbers. In various embodiments, foam core 102 may be covered with shell 104, which may be composed of a more rigid material than core 102, such as a vinyl rubber, or other water resistant, wear resistant or water impervious material(s). Flexible cap 101 may also include a contact layer 107, which may be composed of a material that is more rigid or harder than shell layer 104, such as polyoxymethlene, a hard plastic, or a metallic material. Contact layer 107 is positioned on cap 101 for repetitive sliding contact with a sliding shower door. Accordingly, in an embodiment, such as the embodiment demonstrated in FIG. 1 where flexible cap is configured as a rail on which a shower door slides, contact layer 107 may be coupled to flexible cap 101 as a capping layer configured to cover only an upper portion of the shell 104 where the door will contact layer 107.

Flexible cap 101 may also include additional features such as engagement fin 103 for engaging and thereby coupling cap 101 to an elongated base component. Fin 103 may include one or more ribs 109 configured to engage ridges 116 of base 110. Ribs 109 and ridges 116 may be angled in opposing directions, such that when engaged they resist disengagement because of their interlocking engagement with one another. Flexible cap 101 may also include one or more shrouds 105 and 106 extending from and along the flexible cap and configured to extend from the apex region of an elongated base component that cap 101 caps, to one or more side walls of the base component. Engagement fin 103 and ribs 109 may be composed of the same material as shell 104 in some embodiments and each may be composed of a distinct material in other embodiments. For example, shell 104 may be composed of vinyl, while fin 103 may be composed of plastic or a material having a different durometer than shell 104, while ribs 109 may be composed of a material also having a different durometer than fin 103.

Figure 7:
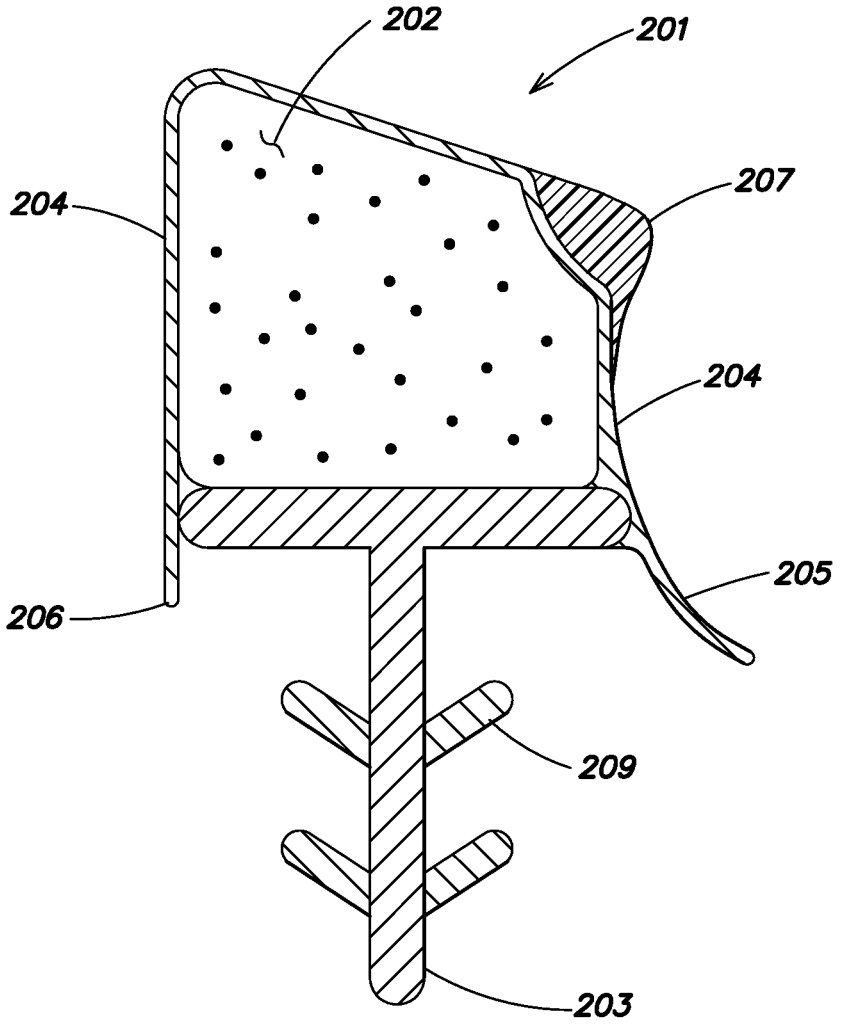
FIG. 7 illustrates a cross sectional view of a soft resilient cap portion of a shower threshold, in accordance with an exemplary inventive embodiment.

FIG. 7 illustrates a cross sectional view of a soft resilient cap portion of a shower threshold, in accordance with an exemplary inventive embodiment. As demonstrated by comparing flexible cap 101 of FIG. 6 and flexible cap 201 of FIG. 7, flexible caps in accordance with various inventive embodiments disclosed herein may have various shapes, which shape may be unique to a function of the flexible (e.g. rail vs. channel wall or guide). Flexible cap 201, like cap 101, may be composed of a plurality of layers in accordance with various embodiments. The plurality of layers assist with providing flexible cap 201 in a soft form for more comfortable interaction with the user, while still providing a resilient guide and water barrier. In accordance with various embodiments, cap 201 may include a core layer 202 composed of a resilient material, such as a foam. In various embodiments, foam core 202 may be covered with shell 204, which may be composed of a more rigid material than core 202, such as a vinyl material, or other water resistant, wear resistant, or water impervious material(s). Flexible cap 201 may also include a contact layer 207, which may be composed of a material that is more rigid or harder than shell layer 204, such as polyoxymethlene, a hard plastic, or a metallic material. Contact layer 207 is positioned on cap 201 for repetitive sliding contact with a sliding shower door. Because cap 201 is configured for engagement with the base of a shower door on an inner side edge of cap 201, contact layer 207 is positioned on an inner side edge of cap 201. As illustrated in FIG. 7, contact layer 207 may be coupled to flexible cap 201 as a capping layer configured to cover only a portion of the shell 204 particularly where the door will contact it.

Flexible cap 201 may also include additional features such as engagement fin 203 for engaging and thereby coupling cap 201 to an elongated base component. Fin 203 may include one or more ribs 209 configured to engage ridges 216 of base 210. Ribs 209 and ridges 216 may be angled in opposing directions, such that when engaged they resist disengagement because of their interlocking engagement with one another. Flexible cap 201 may also include one or more shrouds 205 and 206 extending from and along the flexible cap and configured to extend from the apex region of an elongated base component that cap 201 caps, to one or more side walls of the base component. Engagement fin 203 and ribs 209 may be composed of the same material as shell 204 in some embodiments and each may be composed of a distinct material in other embodiments. For example, shell 204 may be composed of vinyl, while fin 203 may be composed of plastic or a material having a different durometer than shell 204, while ribs 209 may be composed of a material also having a different durometer than fin 203.

Figure 8:
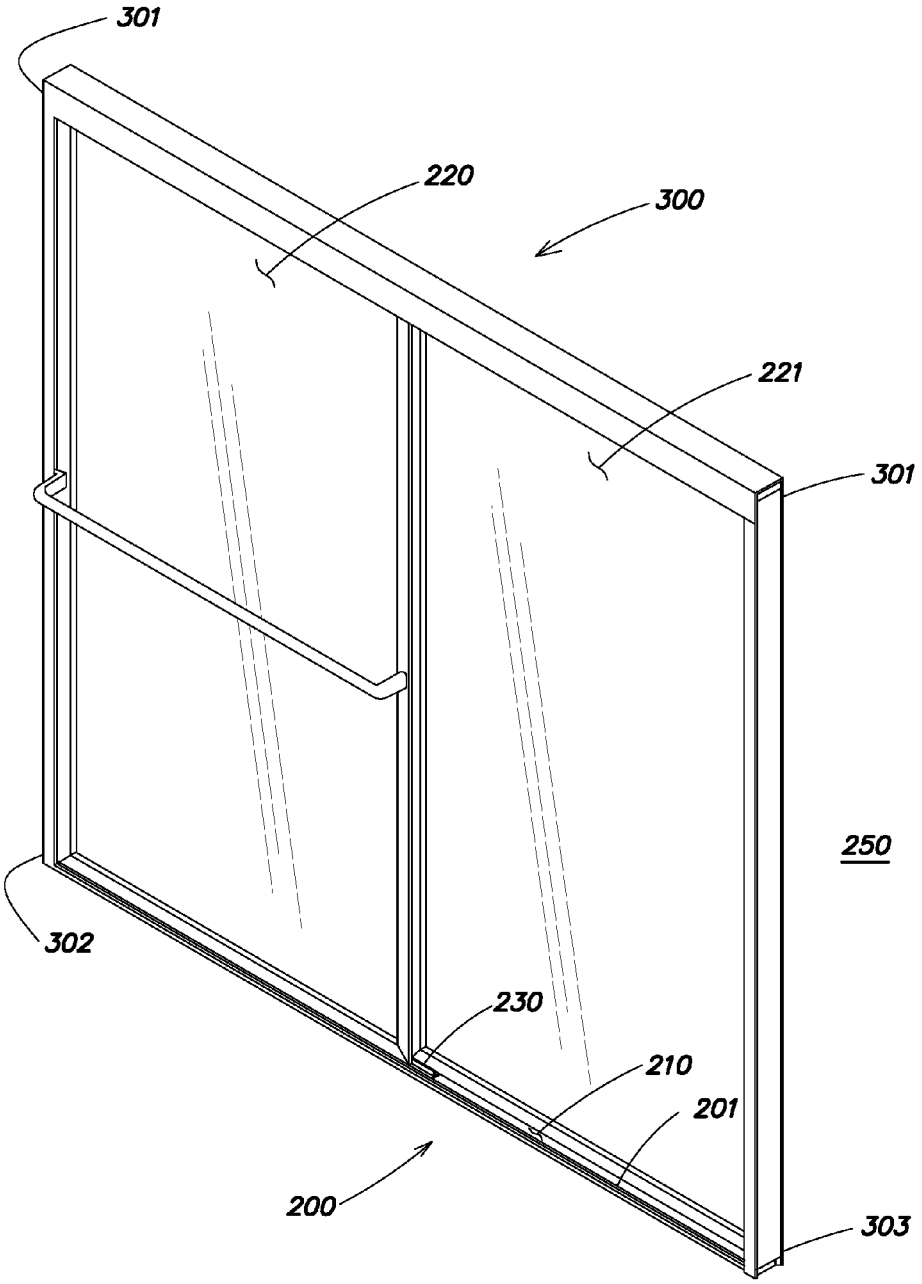
FIG. 8 provides a perspective view of shower doors including a shower threshold, in accordance with an exemplary inventive embodiment.

FIG. 8 provides a perspective view of shower doors including a shower threshold, in accordance with an exemplary inventive embodiment. In the illustrated embodiment, shower door assembly 300 includes a shower frame 301, and an inner shower door 221 and outer shower door 220. Shower threshold 200 extends from one extremity or end 302 to the opposing extremity or end 303. Shower door 221 is positioned within a channel formed by center guide 230. The base of shower door 220 is adjacent to flexible cap 201 of threshold 200, which is coupled to elongated base component 210. Accordingly, the base of shower door 220 is positioned between cap 201 and the outer region of center guide 230. Cap 201 and elongated base 210 are configured, in the illustrated embodiment, to extend from one end 302 to the other end 303. Accordingly, if each of shower doors 220 and 221 are slidably moved to end 302, a soft flexible, water barrier is positioned between the doors and end 303 within the opening to the shower and vice versa if each of doors 220 and 221 are moved to end 303.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

The invention claimed is:

1. A shower threshold comprising:

an elongated base component having one or more sidewalls extending from a base portion of the elongated base component to an apex of the elongated base component, wherein at least one of the one or more sidewalls includes a sloped surface extending upward from the base portion to the apex;

a flexible cap coupled to and extending from the elongated base component along the apex, the flexible cap comprising a plurality of layers; and a center-guide coupled to the inclined surface, the center-guide extending partially along the elongated base component;

wherein the center-guide includes a plurality of walls forming a channel disposed between at least two walls of the plurality of walls, and wherein the plurality of layers of the flexible cap includes a core layer, a shell layer, and a contact layer coupled to at least a portion of an outer layer of the shell layer, wherein the core layer comprises a material that is less rigid than the shell layer and the contact layer includes a material having a greater rigidity than the shell layer.

2. The shower threshold of claim 1, wherein the apex includes a planar surface.

3. The shower threshold of claim 2, wherein the flexible cap covers the planar surface.

4. The shower threshold of claim 2, wherein the planar surface includes a recess positioned therein.

5. The shower threshold of claim 4, wherein the flexible cap includes an engagement fin extending therefrom, the engagement fin positioned in the recess.

6. The shower threshold of claim 5, wherein the recess includes a plurality of ridges, configured to engage the engagement fin.

7. The shower threshold of claim 1, wherein the elongated base component comprises extruded aluminum.

8. The shower threshold of claim 1, wherein the core layer is foam.

9. The shower threshold of claim 1, wherein the shell layer is polymeric.

10. The shower threshold of claim 1, wherein the contact layer includes a metal.

11. The shower threshold of claim 1, wherein the contact layer includes a polymer.

12. The shower threshold of claim 1, wherein the flexible cap includes at least one shroud extending from the flexible cap, the shroud extending from the apex to at least one of the one or more sidewalls.

13. A method of implementing a shower threshold comprising:

coupling a flexible cap to an elongated base component to define a threshold, the elongated base component having one or more sidewalls extending from a base region of the elongated base component to an apex of the elongated base component, the flexible cap coupled to the elongated base component such that the flexible cap extends from the elongated base component along the apex, the flexible cap comprising a plurality of layers;

securing the threshold at a base of an opening to a shower; and positioning at least one shower door in the opening such that a base of the at least one shower door is adjacent to the flexible cap and positioned between the shower and the flexible cap;

wherein the plurality of layers of the flexible cap includes a core layer, a shell layer, and a contact layer coupled to at least a portion of an outer layer of the shell layer, wherein the core layer comprises a material that is less rigid than the shell layer and the contact layer includes a material having a greater rigidity than the shell layer.

14. The method of claim 13, wherein the at least one shower door includes at least one sliding shower door.

15. The method of claim 14, further comprising guiding the at least one sliding shower door via the flexible cap when the at least one sliding shower door is moved from a first end of the opening to a second end of the opening.

16. The method of claim 13, wherein at least one of the one or more sidewalls includes an inclined surface extending upward from the base region of the elongated base component to the apex of the elongated base component.

17. The method of claim 16, further comprising coupling a center-guide to the inclined surface, the center-guide extending partially along the elongated base component.

* * * * *